US005662868A

United States Patent [19]

Letzsch et al.

[11] Patent Number: 5,662,868

[45] Date of Patent: Sep. 2, 1997

[54] SHORT RESIDENCE TIME CRACKING APPARATUS AND PROCESS

[75] Inventors: Warren S. Letzsch; Gerald Earl, both of Houston, Tex.

[73] Assignee: Stone & Webster Engineering Corporation, Boston, Mass.

[21] Appl. No.: 310,529

[22] Filed: Sep. 22, 1994

[51] Int. Cl.[6] ..... F27B 15/08; C10G 11/00

[52] U.S. Cl. ..... 422/144; 422/145; 422/147; 208/113; 208/151

[58] Field of Search ..... 422/144–147; 208/48 Q, 113, 120, 150, 151

[56] References Cited

U.S. PATENT DOCUMENTS

| | | | |
|---|---|---|---|
| 2,886,419 | 5/1959 | Orr et al. | 422/147 |
| 2,906,695 | 9/1959 | Boston | 208/127 |
| 4,002,438 | 1/1977 | Fleming | 422/144 |
| 4,035,284 | 7/1977 | Gross et al. | 208/120 |
| 4,219,407 | 8/1980 | Haddad et al. | 208/151 |
| 4,313,910 | 2/1982 | Dries et al. | 422/147 |
| 4,404,095 | 9/1983 | Haddad et al. | 208/161 |
| 4,588,558 | 5/1986 | Kam et al. | 422/113 |
| 4,664,888 | 5/1987 | Castagnos, Jr. | 422/147 |
| 4,689,206 | 8/1987 | Owen et al. | 422/144 |
| 4,764,268 | 8/1988 | Lane | 208/113 |
| 4,789,458 | 12/1988 | Haddad et al. | 208/151 |
| 4,814,067 | 3/1989 | Gartside et al. | 208/127 |
| 4,853,187 | 8/1989 | Herbst et al. | 422/144 |
| 4,869,880 | 9/1989 | Hettinger, Jr. et al. | 422/147 |
| 4,909,993 | 3/1990 | Haddad et al. | 422/144 |
| 4,946,656 | 8/1990 | Ross et al. | 422/144 |
| 4,963,328 | 10/1990 | Haddad et al. | 422/144 |
| 4,978,440 | 12/1990 | Krambeck et al. | 208/113 |
| 5,043,058 | 8/1991 | Forgac et al. | 208/48 Q |
| 5,073,249 | 12/1991 | Owen | 208/48 Q |
| 5,077,252 | 12/1991 | Owen et al. | 502/43 |
| 5,089,235 | 2/1992 | Schwartz et al. | 422/144 |
| 5,112,576 | 5/1992 | Kruse | 422/144 |
| 5,141,625 | 8/1992 | Lomas | 208/113 |
| 5,158,669 | 10/1992 | Centinkaya | 208/113 |
| 5,248,408 | 9/1993 | Owen | 208/113 |
| 5,259,855 | 11/1993 | Ross, Jr. et al. | 55/349 |
| 5,288,920 | 2/1994 | Chan et al. | 422/146 |
| 5,308,473 | 5/1994 | Markham et al. | 208/113 |
| 5,409,879 | 4/1995 | Raterman | 502/44 |
| 5,449,497 | 9/1995 | Cetinkaya | 422/144 |

FOREIGN PATENT DOCUMENTS

| | | | |
|---|---|---|---|
| 1387919 | 3/1975 | United Kingdom | B01J 8/28 |

OTHER PUBLICATIONS

Hatch & Matar, "From Hydrocarbons To Petrochemicals," Chapter 3, 1981, Houston, Texas, pp. 15–37.

*Primary Examiner*—Christopher Kim

*Attorney, Agent, or Firm*—Hedman, Gibson & Costigan, P.C.

[57] ABSTRACT

A novel apparatus and process for the cracking of hydrocarbons is disclosed which is particularly useful in revamping an existing FCC unit to a short residence time FCC unit.

19 Claims, 4 Drawing Sheets

SHORT RESIDENCE TIME CRACKING APPARATUS AND PROCESS

The present invention relates to an apparatus for providing short residence time cracking of hydrocarbons. The present invention also relates to a method for modifying an existing fluid catalytic cracking (FCC) system to a shorter residence time FCC system.

BACKGROUND OF THE PRESENT INVENTION

The FCC process has in recent times become the major system by which crude oil is converted into gasoline and other hydrocarbon products. Basically, the FCC process includes contacting a hot particulate catalyst with a hydrocarbon feedstock in a riser reactor to crack the hydrocarbon feedstock, thereby producing cracked products and spent coked catalyst. The coked catalyst is separated from the cracked products, stripped and then regenerated by burning the coke from the coked catalyst in a regenerator. The catalyst is heated during the regeneration by the burning of the coke. The hot catalyst is then recycled to the riser reactor for additional cracking. Exemplary of these FCC processes are Haddad et al., U.S. Pat. No. 4,404,095, Lane, U.S. Pat. No. 4,764,268, Quinn et al., U.S. Pat. No. 5,087,427, Forgac et al., U.S. Pat. No. 5,043,058 and Schwartz et al., U.S. Pat. No. 5,089,235.

For the most part, the existing FCC systems were built to provide relatively long riser reactors in order to increase riser cracking and decrease subsequent dense bed cracking in the disengaging or stripping vessel. A typical conventional riser reactor provides a residence time of less than 10 seconds, and usually on the order of 1–5 seconds. See generally, Krambeck et al., U.S. Pat. No. 4,978,440.

Recently, the decrease in available lighter feedstocks has resulted in the need to employ heavier hydrocarbons as the FCC feedstock. Further, catalysts having improved activity have also become available. Also the need to make lighter products can also make it desirable to operate at substantially higher reactor temperatures than are usually employed in conventional FCC operations. It has been found that it is beneficial to employ shorter residence times in FCC processes in which heavier hydrocarbons are employed as the feedstock and/or where high activity catalyst and/or higher (greater than 1000° F.) reactor temperatures are employed. Thus there is currently a need in the industry to provide a system for cracking these heavier feeds and/or employing high activity catalysts and/or higher reactor temperatures and which can be adapted from current existing systems in FCC refineries.

SUMMARY OF THE PRESENT INVENTION

It is therefore an object of the present invention to provide an apparatus for the cracking of hydrocarbons.

It is also an object of the present invention to provide an apparatus which is useful in a short residence time FCC system.

It is a further object of the present invention to provide a method for converting an existing FCC system into a short residence time FCC system.

It is another object of the present invention to provide an apparatus for steam stripping the spent catalyst from an FCC system.

It is still another object of the present invention to provide a process for cracking hydrocarbons in an FCC system which is especially adapted for revamped FCC systems.

To this end, the present invention provides an apparatus for providing short residence time cracking of hydrocarbons.

The present invention also provides a method for modifying an existing FCC system to a short residence time FCC system.

The novel method for revamping a relatively long residence time riser reactor terminating in a stripper vessel to a short residence time riser reactor comprises (a) severing the riser reactor into a short residence time riser reactor and a riser product conduit having an upstream end and a downstream end wherein the downstream end of the riser product conduit is operatively connected to the stripper vessel; (b) operatively connecting a separating means to the top of the short residence time riser reactor, the separating means having at least one cracked product outlet conduit and at least one spent catalyst dipleg; (c) operatively connecting each cracked product outlet conduit to the upstream end of the riser product conduit; (d) operatively connecting each spent catalyst dipleg to a downstream end of one or more steam stripper risers; and (e) operatively connecting the upstream end of each steam stripper riser to the stripper vessel.

The present invention further provides a stripping method and apparatus for use with a modified FCC system.

Still further, the present invention provides a process for catalytically cracking hydrocarbons comprising: (a) contacting a hydrocarbon feedstream with a cracking catalyst in a riser reactor to produce an effluent comprising a cracked product and spent catalyst; (b) passing the riser reactor effluent through a separating means to produce a stream of cracked product having a relatively minor amount of entrained catalyst and a stream of spent catalyst; (c) directing the stream of cracked product into an upper dilute phase of a stripper vessel; (d) stripping volatile hydrocarbons from the spent catalyst by contacting the spent catalyst with steam in a stripper riser to produce a stripper effluent stream comprising volatile hydrocarbons, steam and stripped spent catalyst; (e) directing the stripper effluent stream into the upper dilute phase of the stripper vessel; and (f) separating cracked product, volatile hydrocarbons and steam from entrained catalyst and stripped spent catalyst in the stripper vessel; (g) withdrawing separated cracked product, volatile hydrocarbons and steam from the stripper vessel; and (h) directing separated entrained catalyst and stripped spent catalyst to a lower dense phase bed of the stripper vessel.

DETAILED DESCRIPTION OF THE PRESENT INVENTION

Figure 1:
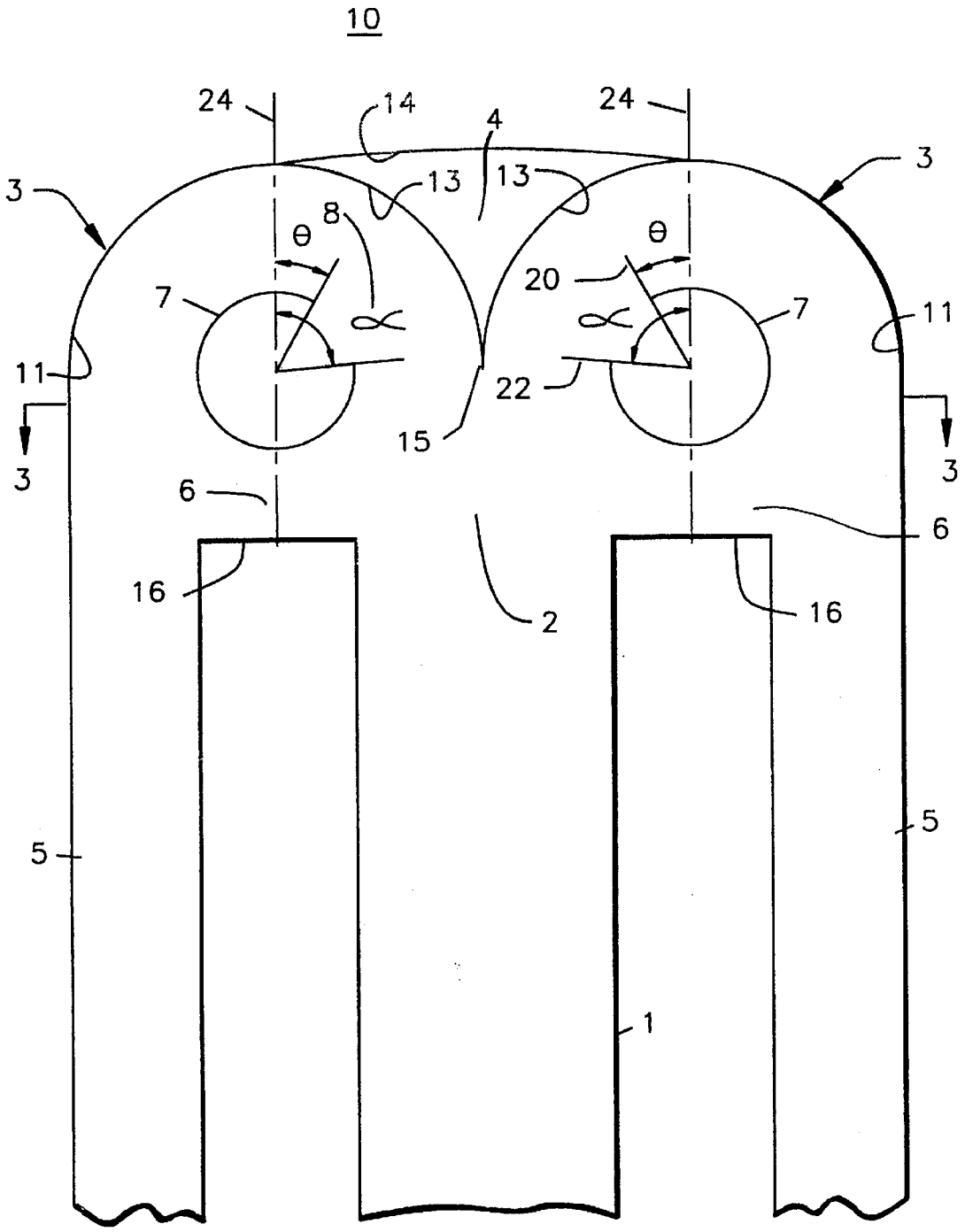
FIG. 1 is a cross sectional view of a separation apparatus useful in the practice of the present invention.

The novel short residence time cracking apparatus of the present invention broadly comprises (a) a riser reactor for catalytically cracking a hydrocarbon feed in the presence of catalyst to produce cracked product and spent catalyst; (b) separating means operatively connected to the riser reactor for separating at least a substantial portion of the spent catalyst from the cracked product; (c) stripper vessel inlet means for receiving the separated cracked product from the separating means; (d) a stripper vessel having an upper dilute phase and a lower dense phase bed, wherein the upper dilute phase is operatively connected to the stripper vessel inlet means; (e) a catalyst dipleg for removing spent catalyst from the separation means; and (f) a steam stripper riser operatively connected to the catalyst dipleg for steam stripping the spent catalyst and delivering stripped catalyst to the stripper vessel.

Any conventional FCC feed may be employed in the practice of the present invention. Usually the feed to an FCC unit comprises gas oils, vacuum gas oils, topped crudes etc. Particularly useful in the practice of the present invention are the heavy feeds, such as residual oils, tar sands, shale oil and asphaltic fractions.

Similarly, any of the known FCC catalysts can be employed in accordance with the present invention. Preferably, the catalyst is one of the many commercially available zeolite based catalysts, i.e. crystalline aluminosilicates. Especially preferred are zeolites having relatively large pores such as those in the faujasite family, i.e., type Y, US-Y, chemically treated type Y, hydrochemically treated type Y, direct synthesis of high silica/alumina (Si/Al>6) faujasite, all with rare earth and/or ammonium exchanged. Active matrices for these catalysts are also preferred. Optionally, the catalyst may contain one or more of known promoters, such as CO oxidation promoters including but not limited to platinum components, metal passivation promoters, etc. These are well known to those skilled in the art and are described in the patent literature. See, e.g., Bertus et al., U.S. Pat. No. 4,238,637 and McKay et al., U.S. Pat. No. 4,283,274. Catalysts employing medium pore size zeolites (about 5–6 Å) but smaller than the pores contained in the faujasite structure, can also be used either by themselves or with the large pore zeolites, e.g., faujasites, to produce light olefins ($C_2$–$C_5$) for intermediate or finished petrochemical and/or refinery process.

Any conventional riser reactor can be employed in the present invention. The only limitation on the riser is that the riser be sized to provide the required short residence time. Short residence time is defined as a residence time of intimate contact between hydrocarbon feedstock and catalyst of less than 1 second and preferably less than 0.6 seconds based on the vapor exit velocity of the riser. In the short residence time riser reactor, the hydrocarbon feedstock is cracked to a gaseous product stream, and coke becomes deposited on the catalyst particles.

In converting an existing conventional FCC riser reactor to a short residence time riser reactor, the riser reactor is cut or bisected (see reference character A and A' in FIGS. 2 and 3, respectively) to the desired length. In this manner the lower portion constitutes a short residence time riser reactor and the upper portion constitutes a stripper vessel inlet means or riser product conduit.

At the top of the short residence time riser reactor external to the stripper vessel is located a first separation means which provides a quick gross separation of the cracked products from the spent catalyst. It is contemplated herein that after the gross separation in the first separation means, some catalyst particles and catalyst fines will remain entrained with the cracked products.

The first separation means can be any of those known to those skilled in the art, including but not limited to a cyclone separator, an inverted can separator, e.g. Pfeiffer et al., U.S. Pat. No. 4,756,886, a baffle separator, e.g., Haddad et al., U.S. Pat. No. 4,404,095, a rams horn separator as disclosed in Ross et al., U.S. Pat. No. 5,259,855, a global separator as disclosed in Barnes, U.S. Pat. No. 4,891,129 and/or a U-shaped separator as disclosed in Gartside et al., U.S. Pat. No. 4,433,984.

Especially preferred is a rams horn type separator. Referring to FIG. 1, the separator 10 is comprised of a separator housing 3, deflection means 4, two parallel gas outlets 7, two downwardly flowing solids outlets or diplegs 5 and a centrally located cracked gas-solids inlet 2.

The centrally located cracked gas-solids inlet 2 is located in the base of the separator 10, directly above the terminal end of the short residence time riser reactor 1. The deflection means 4 is wedge-shaped with the side walls 13 having a concave shape. The base 14 of the deflection means 4 is attached to the inner surface 11 of the separator housing. The point 15 of the deflection means 4 is preferably located directly above the center of the centrally located cracked gas-solids inlet 2. The deflection means divides the separator 10 into two distinct semi-circular separating areas 6. It is also contemplated that the rams horn separator may have between one (a half rams horn) and four or more separating areas. Typically, there will be two semi-circular separating areas 6. The semi-circular separating areas 6, are defined by the concave side walls 13 of deflection means 4 and the concave walls 11 of the separator housing 3.

Each semi-circular separating area 6, contains a gas outlet 7. Each gas outlet 7 is horizontally disposed and runs parallel to the base 16 of the separator 10 and parallel to the inner concave surface 11 of the separator housing 3. Each gas outlet 7 also contains a horizontally disposed gas opening 8 which can be located at any position around the gas outlet 7. In a preferred embodiment, the horizontally disposed gas opening 8 extends the length of the gas outlet 7, and is positioned to face upwardly and inwardly, with respect of the riser reactor 1, toward deflection means 4. The lower edge 22 of the gas opening 8 is at an angle $\alpha$ to the vertical center line 24 of the gas outlet tube 7 and the upper edge 20 is at an angle $\Theta$ to the vertical center line 24. The angle $\alpha$ can range from 30° to 135° with the preferred range being 30° to 90° and the angle $\Theta$ can range from −30° to 75° with the preferred range being 0° to 30°.

In one embodiment of the separator, the gas opening 8 is oriented toward the riser reactor 1 and directed upward. The angle $\alpha$ is about 90° to the vertical center line 24 and the angle $\Theta$ is about 30° to the vertical center line 24.

It is also contemplated that the horizontally disposed gas opening 8 extends the length of the gas outlet 7 and is positioned to face outwardly, with respect to the riser reactor 1, toward the concave surface 11 of the separator.

The gas outlets remove the cracked product, generally entrained with a small portion catalyst fines and particulates, i.e., from 0–10% by weight, more preferably 0–5% and most preferably 0.1–2%, from the first separating means. The gas outlets in turn direct the cracked product into an inlet means to a disengaging or stripper vessel. The inlet means is preferably a conduit, which in the case of a revamped FCC unit comprises the riser product conduit.

The stripper vessel inlet means or riser product conduit may enter the stripper or disengaging vessel in a variety of positions. The inlet means or riser product conduit can enter the vessel from the side or preferably through the center of the bottom of the vessel.

In one embodiment, the inlet means enters the vessel centrally through the bottom and is close coupled to a secondary cyclone separator located in the upper dilute phase of the vessel. In the secondary cyclone, any entrained catalyst particulates or catalyst fines are separated from the cracked products. The cracked products are then removed from the vessel and directed to a downstream processing facility, as is known to those skilled in the art.

Alternatively, the inlet means can discharge the cracked product vapor directly into the upper dilute phase of the vessel. In this type of embodiment, a second separation means at the downstream end of the stripper vessel inlet means may optionally be employed. The cracked product vapor is then drawn into a secondary cyclone inlet for further separation of entrained catalyst fines and particulates. The second separation means may be a tee separator, inertial separator, vented riser, axial cyclone, or rams horn type separator.

The entrained catalyst fines and particulates separated from the cracked product vapor in the secondary cyclone and optionally the second separating means are then directed into the dense bed of catalyst in the bottom of the vessel via a dipleg as is well known to those skilled in the art.

In an alternative embodiment, it is contemplated by the present invention to include one or more quench means (as shown by reference character 157 in FIG. 3A) to quench the cracked product vapor. The quench means can be located in the first separation means outlets, in the riser product conduit or stripper vessel inlet means, in the second separation means outlets (if any), at the entrance to the secondary cyclone, or in the case of an open secondary cyclone in the dilute phase of the vessel, at a location above the outlet of the inlet means or at a position in the dilute phase directly above the dense bed of catalyst.

It is further contemplated by the present invention that the average total kinetic residence time of the hydrocarbons in the FCC process, i.e., from the time of contact of the feedstock with the catalyst through quenching of the cracked product, is less than 1 second, more preferably less than 0.6 seconds. Typically the average total kinetic residence time will be on the order of from about 0.05 seconds to about 0.6 seconds.

The quench can comprise a variety of quench media known to those skilled in the art, including hydrocarbon liquids, and water or steam. Desirably, the quench is a hydrocarbon liquid which has previously been cracked or otherwise processed to remove the most reactive species. Thus, particularly suitable as quench media are kerosene, light coker gas oil, coker still distillates, hydrotreated distillate, fresh unprocessed virgin feedstocks such as virgin gas oil, heavy virgin naphtha and light virgin naphtha, light catalytic cycle oil, heavy catalytic cycle oil, heavy catalytic naphtha and mixtures of any of the foregoing.

The first separating means also contains at least one downwardly flowing solids outlet. The downwardly flowing solids outlets or diplegs are directed in parallel to the riser reactor for a length sufficient to provide a sealing of the diplegs. At the end of each of the diplegs, the diplegs preferably flare out at an angle and direct the spent catalyst into the bottom of the steam stripper riser. A mechanical valve may also be employed to control the catalyst flow but is not necessary. The valves may comprise any mechanical valve known to those skilled in the art including but not limited to slide valves or trickle valves. The valves act to control the flow of the catalyst out of the diplegs. Alternatively, it is contemplated that a J bend or J valve may be used to provide a seal.

The diplegs direct the coked catalyst particulates into a steam stripper riser wherein steam is admitted to lift the catalyst particles and strip volatile hydrocarbons from the coked catalyst particulates in a dilute phase. The steam stripper riser is typically a straight vertical transfer line conduit which runs parallel to the riser reactor and enters the stripper vessel in the dilute phase. It is further contemplated that a third separating means may be employed at the downstream end of the steam stripper riser. In the third separating means, volatile hydrocarbons and steam are separated from the stripped spent catalyst. The volatile hydrocarbons and steam are then directed to the dilute phase of the stripper vessel, while the stripped spent catalyst are directed into the lower dense phase bed of the stripper vessel.

The stripper vessel is a vessel that is designed to receive the effluents from a riser reactor and the steam stripper riser, and contain an upper dilute phase and a lower dense bed of catalyst. The stripping or disengaging vessel is conventionally a relatively large vessel, usually several orders of magnitude larger in volume than the riser reactor, which serves to collect spent catalyst in the lower portion of the vessel, i.e. the dense phase bed, and the vapors in the upper portion of the vessel, i.e. dilute phase. The spent catalyst is withdrawn from the bottom of the vessel, usually through a stripper zone containing baffles and/or other devices for providing intimate contacting of the steam and catalyst and removed from the vessel. Stripping steam is added in one or more places and usually at the bottom of the vessel through a ring to displace remaining easily strippable hydrocarbons from the spent catalyst, so that these strippable hydrocarbons can be recovered and not burned in the regenerator.

The stripped catalyst are then directed to an FCC regenerator. Any conventional FCC regenerator known to those of ordinary skill in the art can be used in conjunction with the present invention. Particularly useful in the practice of the present invention are the stacked regenerators, with a first dense bed or coke combustor, a dilute phase transport riser and a second dense bed of hot regenerated catalyst maintained generally above the coke combustor. Catalyst coolers may also be employed in combination with the regenerators, as is well known to those skilled in the art. The regenerated catalyst can then be recycled to the riser reactor as is well known to those skilled in the art.

DESCRIPTION OF THE PREFERRED EMBODIMENTS

Figure 2:
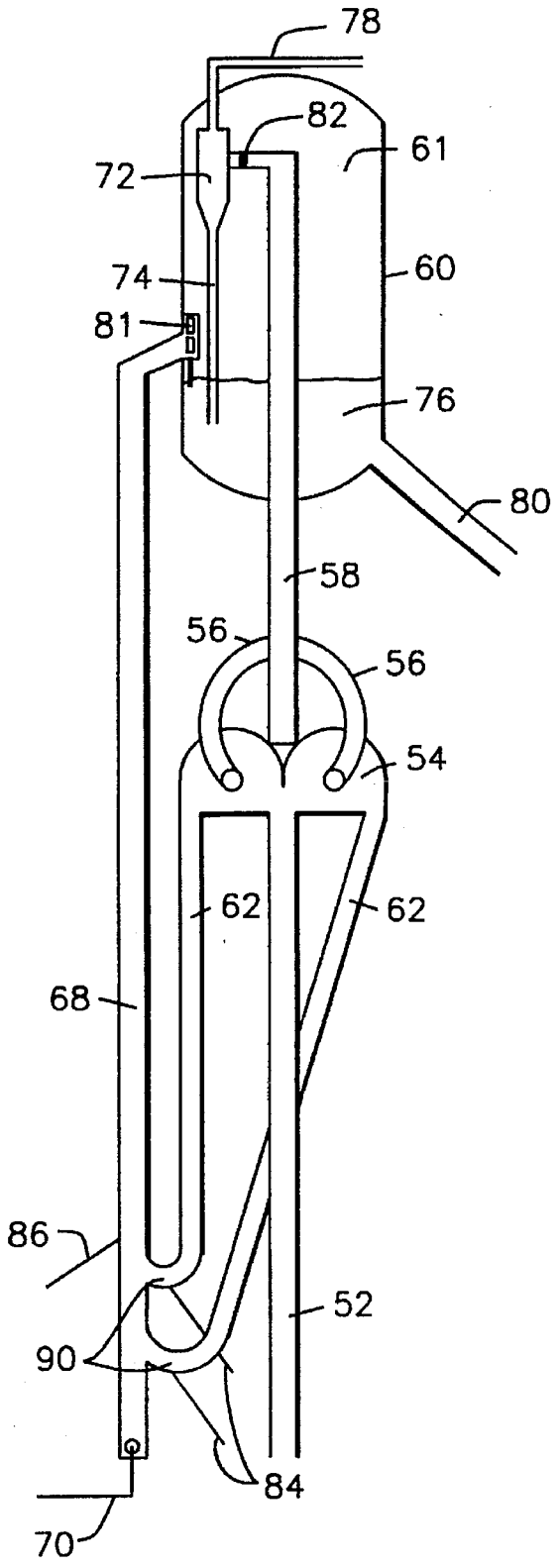
FIG. 2 is a cross sectional view of a preferred embodiment of the present invention.

Referring to FIG. 2, a short residence time riser reactor 52, constituting the lower portion of a severed existing FCC riser reactor, for cracking hydrocarbons in the presence of a cracking catalyst terminates in a rams horn separator 54.

In the rams horn separator 54 the cracked product is removed via conduits 56 and directed to the riser product conduit 58, constituting the upper portion of the severed existing FCC riser reactor, for passage into a stripper vessel 60. In the stripper vessel 60, the riser product conduit 58 is close coupled to a cyclone separator 72 for removal of any entrained catalyst particles from the cracked product vapor. An opening 82 in the riser product conduit 58 allows steam and vapors to enter from the dilute phase 61 of the stripper vessel 60. It is not necessary to close couple the cyclones as long as conduit 58 discharges near the cyclone inlet 73. Cyclones 72 can be one or two stages. The cracked product vapor is then removed from the cyclone 72 via a conduit 78 for downstream processing. Any remaining catalyst fines which are separated in cyclones 72 are directed into the dense bed 76 via diplegs 74.

The spent catalyst is removed from the rams horn separator 54 via diplegs 62 which terminate in the steam stripper riser 68. J-valves 90 provide seals for the diplegs and steam can be injected at steam injection points 84, 86, 71 to control flow.

Steam is admitted into steam stripper riser 68 through steam line 86 and steam ring 71 supplied with steam via line 70. As the spent catalyst are transported up the steam stripper riser 68, residual hydrocarbons are removed from the spent catalyst. The stripped spent catalyst and residual hydrocarbons are then directed into the stripping vessel 60 wherein the residual hydrocarbons and steam are released into the upper dilute phase 61, while the stripped spent catalyst are directed into the lower dense phase 76 for additional optional stripping. A catalyst/vapor separation device 81 is used to direct the catalyst via dipleg 77 to the lower dense phase bed 76 and the vapors via outlets 83 toward the discharge cyclones 72 through opening 82. The separation device 81 can be any of those known in the industry, including but not limited to, tee, rough cut cyclone, rams horn type, etc., with the discharge of the vapor 83 at any point in the vessel 60, but preferably away from bed 76. The catalyst is removed from the stripping vessel 60 via a standpipe 80 for regeneration and recycling to the riser reactor 52.

Figure 3:
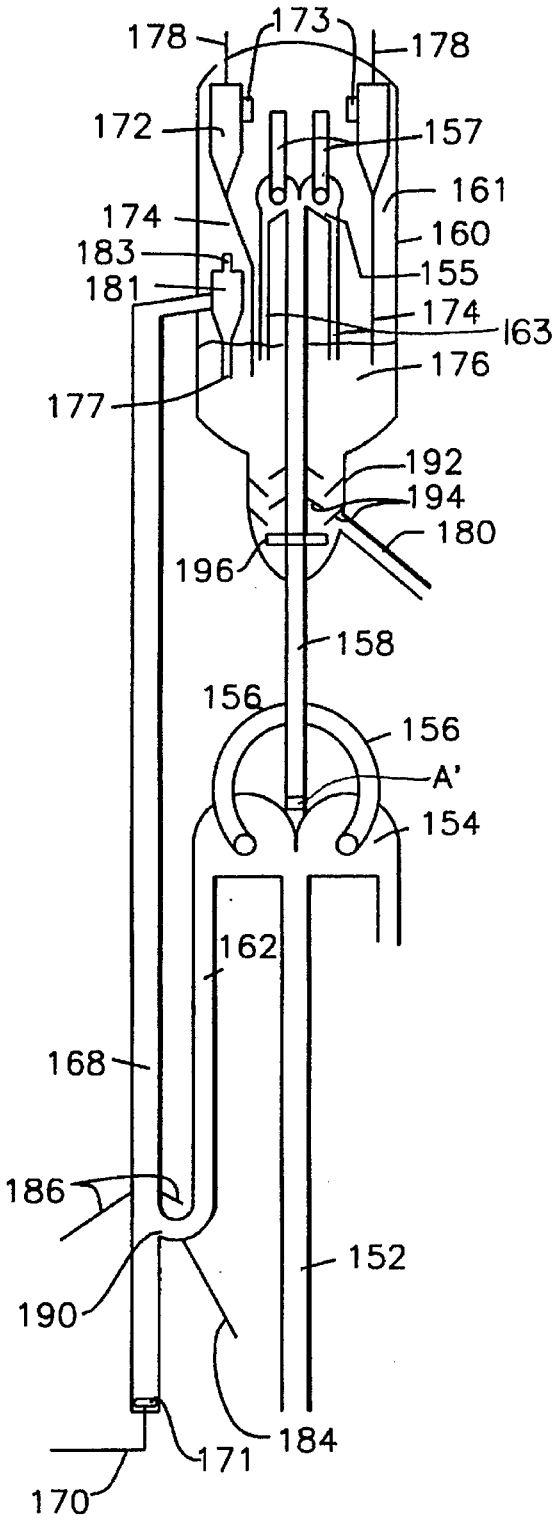
FIG. 3 is a cross sectional view of another preferred embodiment of the present invention.

Referring now to FIG. 3, there is described an alternative embodiment of the present invention. In FIG. 3, cracked product and spent catalyst in short residence time riser reactor 152 enter rams horn separator 154 for separation. The cracked product vapor with entrained catalyst particulates exit the separator 154 in outlets 156. The outlets 156 direct the product vapor and entrained catalyst particulates into riser product conduit 158.

Riser product conduit 158 discharges the product vapor and entrained catalyst particulates into a second rams horn separator 155 to separate a substantial portion of the entrained catalyst particulates from the cracked product vapor. Alternatively, any of the other known separation means may be employed in place of the second rams horn separator, as described hereinabove. The cracked product vapor substantially free of entrained catalyst particulates exits the second rams horn separator 155 in outlets 157 for discharge into the upper dilute phase 161 of stripper vessel 160.

Concurrently, the separated entrained catalyst particulates exit the second rams horn separator 155 in diplegs 163 for discharge into the lower dense phase bed 176 of stripper vessel 160.

The separated particulate solids from the first rams horn separator 154 are removed in diplegs 162 which terminate in the steam stripper riser 168. J-valves 190 provide seals for the diplegs and steam can be injected at steam injection points 184, 186, 171 to control flow.

Steam is admitted into stripper riser 168 through steam line 186 and steam ring 171 supplied with steam through line 170. As the spent catalyst particulates are transported up the stripper riser 168, residual hydrocarbons are removed from the spent catalyst. The stripped spent catalyst and residual hydrocarbons are then directed into separation means 181. Separation means 181 may comprise can be any of those known in the industry, including but not limited to, tee, rough cut cyclone, rams horn type, etc.

In separation means 181 the stripped hydrocarbons and steam are withdrawn through outlet 183 for discharge into the upper dilute phase 161 of stripper vessel 160. The stripped spent catalyst are directed into the lower dense phase 176 for additional optional stripping via dipleg 177.

The cracked product vapor discharging from outlets 157 and the stripped hydrocarbons and steam discharging from outlet 183 are directed into inlets 173 of the secondary cyclones 172 for further separation of catalyst fines. The cracked product vapors, stripped hydrocarbons and steam discharge from the cyclones 172 through outlets 178 for downstream processing. Any remaining catalyst fines which are separated in cyclones 172 are directed into the dense bed 176 via diplegs 174.

The catalyst in the dense bed 176 then enter stripping zone 192 wherein baffles 194 provide for intimate contact of the catalyst with steam, entering through steam ring 196. The catalyst is then removed from the stripping vessel 160 via a standpipe 180 for regeneration and recycling to the riser reactor 152.

Figure 3A:
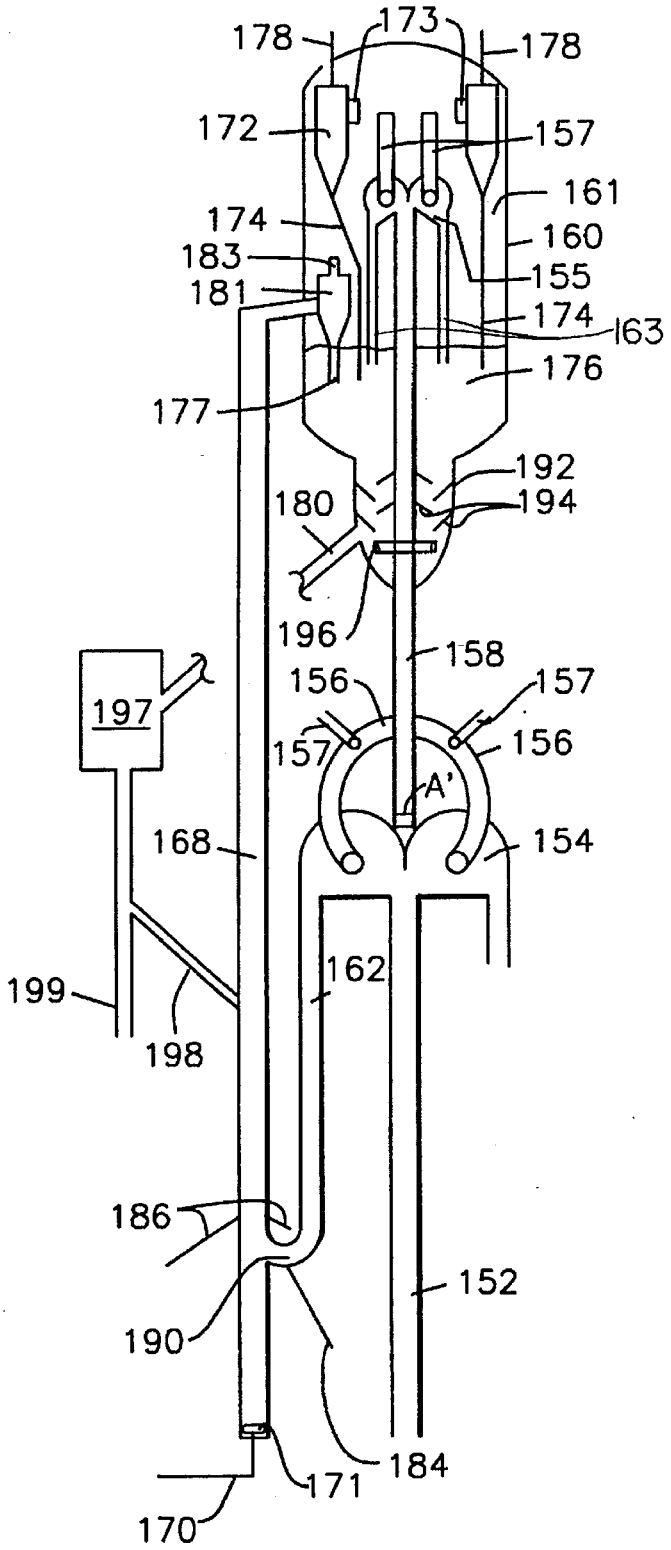
FIG. 3A shows a preferred regeneration and quenching embodiment of the apparatus of the present invention shown in FIG. 3.

Many variations of the present invention will suggest themselves to those skilled in the art in light of the above-detailed description. For example, a quench injector may be added at any point downstream of the first separation means and preferably upstream of the secondary cyclone. Further, the stripper vessel inlet means and the secondary cyclone may or may not be close coupled. Other types of gross cut separators known to those skilled in the art may be employed in place of the rams horn separator. Referring to FIG. 3A, a portion of the hot catalyst from a regenerator 197, e.g., the first and; or second stages of a two stage regenerator, or a single stage regenerator, may be recycled directly to the spent catalyst stripper riser(s) 168 or stripper vessel 160, via a catalyst delivery line 198 to improve stripping by raising the temperature. The remaining portion of the hot catalyst is recycled via a line 199 to the riser reactor 152.

All of the above-referenced patents, patent applications and publications are hereby incorporated by reference.

We claim:

1. A short residence time cracking apparatus comprising:

(a) a riser reactor for catalytically cracking a hydrocarbon feed in the presence of catalyst to produce cracked product and spent catalyst;

(b) separating means operatively connected to said riser reactor for separating at least a substantial portion of said spent catalyst from said cracked product;

(c) stripper vessel inlet means for receiving the cracked product from said separating means;

(d) a stripper vessel having an upper dilute phase and a lower dense phase, wherein said upper dilute phase is operatively connected to said stripper vessel inlet means for receiving the cracked product from said stripper vessel inlet means;

(e) a catalyst dipleg for removing spent catalyst from said separating means; and (f) a steam stripper riser operatively connected to said catalyst dipleg for steam stripping said spent catalyst and delivering stripped catalyst to said stripper vessel.

2. An apparatus as defined in claim 1 wherein said separating means is selected from the group consisting of a cyclone separator, a rams horn separator, an inverted can separator, a global separator and a U-shaped separator.

3. An apparatus as defined in claim 2 wherein said separating means comprises a rams horn separator.

4. An apparatus as defined in claim 3 wherein said rams horn separator comprises two semi circular separating areas, each said semi circular separating area having a gas outlet.

5. An apparatus as defined in claim 4 wherein said stripper vessel inlet means comprises a riser product conduit operatively connected to said gas outlets.

6. An apparatus as defined in claim 1 further comprising in said stripper vessel a secondary cyclone separator operatively connected to said dilute phase for receiving cracked product and separating remaining entrained catalyst particles from said cracked product.

7. An apparatus as defined in claim 6 wherein said secondary cyclone separator comprises two stages.

8. An apparatus as defined in claim 1 further comprising a quench injector means located downstream of said separating means.

9. An apparatus as defined in claim 8 wherein said quench injector means is operatively connected to said stripper vessel inlet means.

10. An apparatus as defined in claim 8 wherein a quench injector means injects quench into said stripper upper dilute phase at a point downstream of said stripper vessel inlet means.

11. An apparatus as defined in claim 6 further comprising a quench injector means which is operatively connected to said stripper vessel inlet means.

12. An apparatus as defined in claim 11 wherein said stripper vessel inlet means comprises a riser product conduit.

13. An apparatus as defined in claim 1 further comprising a second separating means for separating at least a substantial portion of entrained catalyst particles from cracked product located in said stripper vessel and operatively connected to and downstream of said stripper vessel inlet means.

14. An apparatus as defined in claim 13 wherein said second separating means comprises a rams horn separator.

15. An apparatus as defined in claim 1 further comprising a third separating means for separating stripped hydrocarbons and steam from spent catalyst located in said stripper vessel and operatively connected to and downstream of said steam stripper riser.

16. An apparatus as defined in claim 15 wherein said third separating means comprises a rough cut cyclone.

17. An apparatus as defined in claim 1 further comprising:

(g) a catalyst regeneration means operatively connected to the lower dense bed phase of said stripper vessel; and (h) means for delivering a portion of regenerated catalyst from said catalyst regeneration means to said steam stripper riser to increase the temperature in said steam stripper riser.

18. A short residence time cracking apparatus comprising:

(a) a riser reactor for catalytically cracking a hydrocarbon feed in the presence of catalyst to produce cracked product and spent catalyst;

(b) separating means operatively connected to said riser reactor and located external to a stripper vessel for separating at least a substantial portion of said spent catalyst from said cracked product;

(c) stripper vessel inlet means for receiving the cracked product from said separating means;

(d) the stripper vessel having an upper dilute phase and a lower dense bed phase, wherein said upper dilute phase is operatively connected to said stripper vessel inlet means for receiving the cracked product from said stripper vessel inlet means;

(e) a catalyst dipleg for removing spent catalyst from said separating means; and (f) a steam stripper riser operatively connected to said catalyst dipleg for steam stripping said spent catalyst and delivering stripped catalyst to said stripper vessel.

19. A short residence time cracking apparatus comprising:

(a) a riser reactor for catalytically cracking a hydrocarbon feed in the presence of catalyst to produce cracked product and spent catalyst;

(b) separating means operatively connected to said riser reactor and located external to a stripper vessel for separating at least a substantial portion of said spent catalyst from said cracked product;

(c) stripper vessel inlet means for receiving the cracked product from said separating means;

(d) the stripper vessel having an upper dilute phase and a lower dense bed phase, wherein said upper dilute phase is operatively connected to said stripper vessel inlet means for receiving the cracked product from said stripper vessel inlet means;

(e) a catalyst dipleg for removing spent catalyst from said separating means; and (f) a steam stripper riser operatively connected to said catalyst dipleg for stripping volatile hydrocarbons from said spent catalyst with steam and delivering said steam, stripped volatile hydrocarbons and stripped catalyst to said stripper vessel.

* * * * *